US009038584B2

(12) United States Patent
Kashiwabara et al.

(10) Patent No.: US 9,038,584 B2
(45) Date of Patent: May 26, 2015

(54) VALVE OPERATING DEVICE OF ENGINE

(71) Applicant: Mazda Motor Corporation, Aki-gun, Hiroshima (JP)

(72) Inventors: Takashi Kashiwabara, Aki-gun (JP); Akihiro Noda, Hatsukaichi (JP)

(73) Assignee: Mazda Motor Corporation, Hiroshima (JP)

( * ) Notice: Subject to any disclaimer, the term of this patent is extended or adjusted under 35 U.S.C. 154(b) by 0 days.

(21) Appl. No.: 14/184,366

(22) Filed: Feb. 19, 2014

(65) Prior Publication Data

US 2014/0238323 A1 Aug. 28, 2014

(30) Foreign Application Priority Data

Feb. 26, 2013 (JP) ..... 2013-035746

(51) Int. Cl.
*F01L 1/34* (2006.01)
*F01L 13/00* (2006.01)
*F01L 1/047* (2006.01)

(52) U.S. Cl.
CPC ..... *F01L 13/0036* (2013.01); *F01L 1/047* (2013.01); *F01L 2001/0473* (2013.01); *F01L 2013/0052* (2013.01); *F01L 2820/031* (2013.01)

(58) Field of Classification Search
USPC ..... 123/90.15, 90.16, 90.6
See application file for complete search history.

(56) References Cited

U.S. PATENT DOCUMENTS 8,225,759 B2 * 7/2012 Wutzler et al. ..... 123/90.16
2011/0226205 A1 9/2011 Kraus

* cited by examiner

*Primary Examiner* — Zelalem Eshete
(74) *Attorney, Agent, or Firm* — Alleman Hall McCoy Russell & Tuttle LLP

(57) ABSTRACT

A valve operating device for an engine is provided. The device includes a cam element formed with an end face cam in one end thereof, and a control member driven by an actuator to project to an actuated position at which the control member is projected to engage with the end face cam so as to move the cam element in one of the axial directions, and retreat to a non-actuated position at which the control member is retreated from the actuated position. The cam element has a slope inclining in a circumferential direction of the cam element and for, when the control member is at the actuated position, sliding in contact with a contact part provided at the control member so as to forcibly move the control member back to the non-actuated position after the movement of the cam element via the end face cam is finished.

12 Claims, 9 Drawing Sheets

VALVE OPERATING DEVICE OF ENGINE

BACKGROUND

The present invention relates to a valve operating device for an engine of a vehicle, particularly a valve operating device which switches a cam for opening and closing a valve.

A type of valve operating device for an engine is known, which is provided with a plurality of cams having nose parts in different shapes for each valve, and for switching opening degrees and open and close timings of intake and exhaust valves by selecting the cam for opening and closing the valves among the plurality of cams, according to an operating state of the engine.

For example, US2011/0226205A1 discloses such a valve operating device. The valve operating device includes a camshaft comprised of a shaft and a cylindrical cam element spline-fitted onto the shaft and slidable in axial directions along the shaft. For each valve, a plurality of cams, each having a nose part in a different shape, are provided adjacent to each other in the outer circumference of the cam element. The valve operating device switches the cam for opening and closing the valve by sliding the cam element in one of the axial directions.

In this case, in the valve operating device of US2011/0226205A1, an end face cam is formed in both end faces of the cam element, and control members, each comprised of a pin member, are provided to be able to enter into and retreat from respective positions adjacent in the axial directions to the end face cams and push the cam element to respective sides in the axial directions by engaging with the end face cams in the entry. The valve operating device switches the cam by operating the control member with an actuator.

Meanwhile, recently, with engines each including such a valve operating device described above, it has been desired to switch to an optimal cam per unit of combustion cycle according to an operating state of the engine, in other words, successively and instantaneously switch the cam. In this case, in the valve operating device of US2011/0226205A1, it is required to operate, with good responsiveness, control devices provided on both sides of the cam element, each comprised of the control member and an actuator. Specifically, after the cam element is slid to one side in one of the axial directions by one of the control devices, when sliding the cam element in the other direction by the other control device, in order to avoid interference between the control member of the control device that slid the cam element first and the cam element, it is required to swiftly retreat the control member that slid the cam element first.

However, with the actuator of the control device, for which a solenoid is used, a response delay is caused between an output of a retreat signal and the retreat of the control member. Therefore, with the valve operating device of US2011/0226205A1, the retreat of the control member cannot be completed swiftly; thus, it has been difficult to satisfy the above-described desire, particularly in a high speed operation of the engine where a period of time for one cycle is short. Moreover, if the actuator is increased in size so as to accelerate the retreating speed of the control device, disadvantages of increased cost and difficulty of engine installation will arise.

Moreover, these disadvantages are not limited to valve operating devices including end face cams on both end faces of a cam element and control devices for pushing the end face cams. Similar disadvantages to the above arise even with valve operating devices formed with an end face cam on only one end face of a cam element and a control device for pushing the end face cam, and a different component for pushing the cam element from the other end face.

SUMMARY

The present invention is made in view of the above situations and provides a valve operating device for an engine which surely prevents interference between a control member and a cam element while securing its ease of installation in the engine, and successively switches a cam instantaneously.

According to one aspect of the invention, a valve operating device for an engine is provided. The device has a camshaft, the camshaft includes a shaft and a cam element fitted onto the shaft to be integrally rotatable with the shaft and movable in axial directions along the shaft, the cam element is provided with two adjacent cam parts having a common base circle for one valve and having nose parts with different shapes, and the cam part to open and close the valve is switchable by moving the cam element in the axial directions on the shaft. The valve operating device includes a cam element formed with an end face cam in one end thereof, and a control member driven by an actuator to project to an actuated position at which the control member is projected to engage with the end face cam so as to move the cam element in one of the axial directions, and retreat to a non-actuated position at which the control member is retreated from the actuated position. The cam element has a slope inclining in a circumferential direction of the cam element and for, when the control member is at the actuated position, sliding in contact with a contact part provided to the control member so as to forcibly move the control member back to the non-actuated position after the movement of the cam element via the end face cam is finished.

Here, the phrase "cam part" includes a cam part having a nose part formed to have a shape matching that of the base circle (a cam part of which lift is zero).

The cam element may be one of at least two cam elements. The end face cams may be formed in opposing end faces of two adjacent cam elements, and the end face cams respectively have protruding portions being formed offset in phase so that the protruding portions overlap in the axial directions when the two cam elements are close to each other. The control member may be projected to an actuated position at which the control member is projected to engage with the end face cams so as to separate the adjacent cam elements from each other when the cam elements are close to each other, and the control member may be retreated to a non-actuated position at which the control member is retreated from the actuated position. The slope may be formed in one of the adjacent cam elements separated later than the other cam element by the projected control member.

The camshaft may include at least two cam elements. The end face cams may be formed in opposing end faces of two adjacent cam elements, and the end face cams may respectively have protruding portions being formed offset in phase so that the protruding portions overlap in the axial directions when the two cam elements are close to each other. The control member may be projected to an actuated position at which the control member is projected to engage with the end face cams so as to separate the adjacent cam elements from each other when the cam elements are close to each other, and the control member may be retreated to a non-actuated position at which the control member is retreated from the actuated position. Second end face cams may be formed in the other end faces of the two adjacent cam elements. Second control members may be provided for the respective two cam elements. Each of the second control members may be projected to an actuated position at which the second control member is projected, in a state where the cam element is separated from the adjacent cam element, to engage with the second end face cam so as to move the cam element to be close to the adjacent cam element. Each of the second control members may be retreated to a non-actuated position at which the second control member is retreated from the actuated position.

Here, the phrase "two adjacent cam elements" includes two adjacent cam elements each provided for each cylinder of a multi-cylinder engine, and two cam elements provided for two respective valves of one cylinder of a single-cylinder engine or a multi-cylinder engine.

Further, when three or more cam elements are provided at one camshaft, a plurality of sets of the "two adjacent cam elements" exist, and the above configurations may be applied to each set. In this case, each second end face cam and each second control member of one of the sets become one of the opposing end face cams of the two adjacent cam elements in the other set and the control member for engaging with the opposing end face cams, respectively.

The slope may be formed in a circumferential face of the end face cam.

The valve operating device may also include an actuating part for projecting the control member to the actuated position when the engine is at a predetermined rotational angle and keeping, when the control member is forcibly moved back to the non-actuated position by the slope, the control member at the non-actuated position.

According to the above configurations, the following effects can be obtained.

First, by sliding the slope formed in the cam element on the contact part provided to the control member, the control member at the actuated position can surely be forcibly moved to the non-actuated position by the slope. Additionally, since the slope acts after the movement of the cam element by the control member is finished, the control member can swiftly be retreated to the non-actuated position while surely moving the cam element. Thus, even when switching the cam continuously, interference between the control member and the cam element can surely be prevented, and therefore, the switch operation of the cam part can be performed successively and instantaneously.

Moreover, with the simple configuration in which the contact part is provided at the control member and the slope is formed in the cam element, the control member can easily be forcibly moved to the non-actuated position without requiring other kinds of power.

Moreover, since the slope is only formed in one of the adjacent cam elements separated later than the other cam element by projecting the control member to engage with the end face cams when the adjacent cam elements are close to each other, the adjacent cam elements can surely be separated from each other and the control member can swiftly be retreated to the non-actuated position after the movement of the cam elements by the control member is finished.

Moreover, since the slope is only formed in one of the adjacent cam elements separated later than the other cam element, the slope does not need to be formed in each cam element, and thus, the configuration of the valve operating device can be simple.

Moreover, even when the end face cams and the control members are provided at both sides of the cam elements, the configuration of the above aspect can be applied thereto. For example, even when the second end face cam and the second control member, both provided on the other end face side, cooperate with each other to move the cam element to be close to the adjacent cam element, the control member which has moved the cam element to be far from the adjacent element has already swiftly been retreated to the non-actuated position after the movement of the cam element to be far from the adjacent element is finished. Therefore, interference between the cam element moving to be close to the adjacent cam element and the control member can be prevented. Interference between the cam element moving to be far from the adjacent cam element and the second control member can similarly be prevented. Moreover, since the opposing end face cams respectively have the protruding portions being formed offset in phase so that the protruding portions overlap in the axial directions when the two cam elements are close to each other, the adjacent cam elements can be arranged close to each other without increasing the size of the single control member for engaging with the opposing end face cams, and thus, the size of the camshaft in the axial directions can be reduced more.

Furthermore, by forming the slope in the circumferential face of the end face cam, the slope is located near the control member. Therefore, the contact part provided at the control member can be formed small. Thus, an unnecessary increase in the weight of the control member can be prevented and the projecting speed and the retreating speed of the control member can be suppressed from reducing.

Moreover, the actuating part can project the control member to the actuated position when the engine is at the predetermined rotational angle, and the actuating part can surely keep, when the control member is forcibly moved back to the non-actuated position, the control member at the non-actuated position. Thus, the switch operation of the cam part can surely be performed.

DETAILED DESCRIPTION OF EMBODIMENT

Hereinafter, one embodiment of the present invention is described by using a valve operating device for a four-cylinder, four-valve DOHC engine as an example, in which two intake valves and two exhaust valves are provided for each cylinder.

Figure 1:
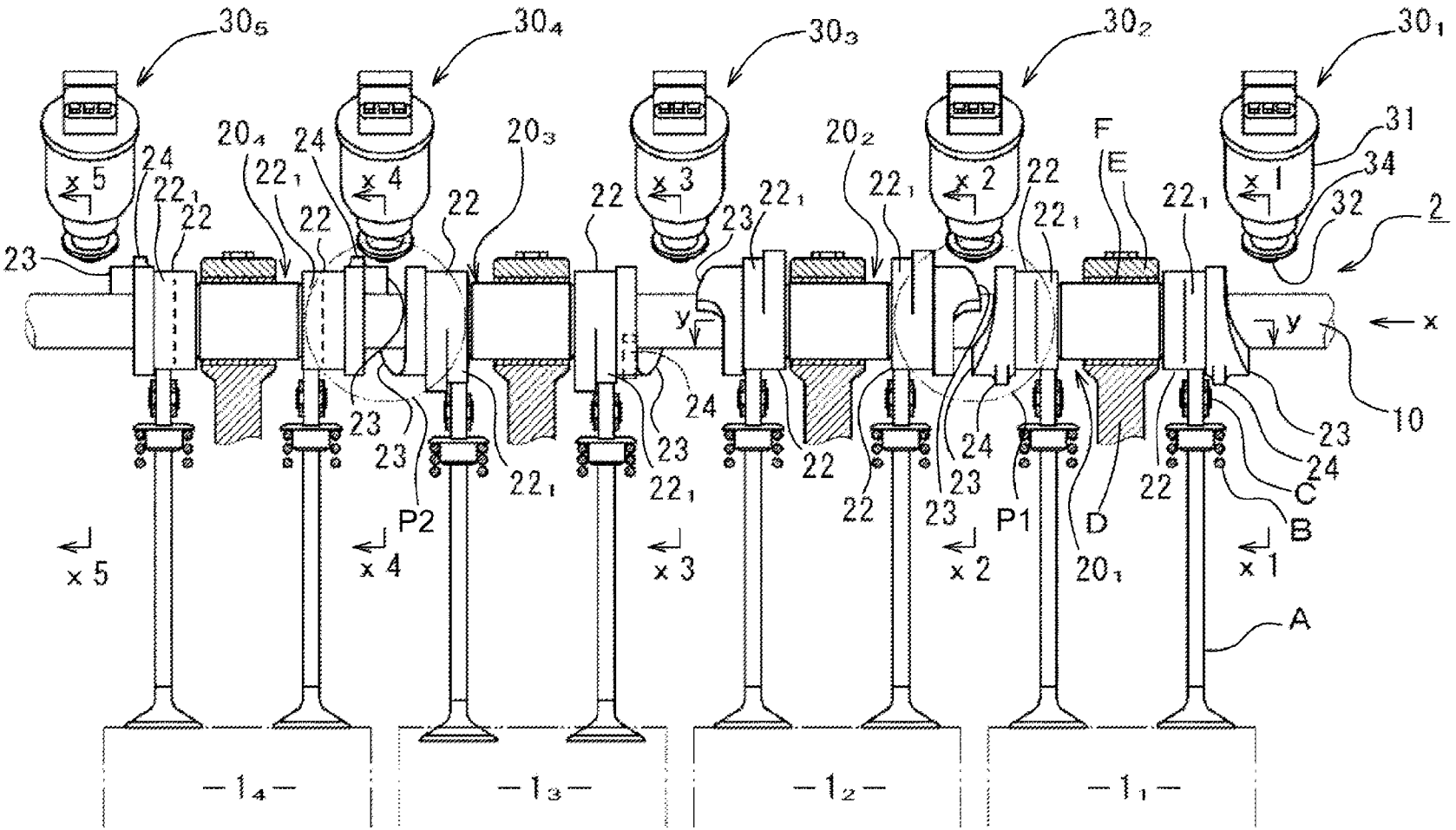
FIG. 1 is a side view schematically illustrating a configuration of an exhaust side valve operating device according to one embodiment of the present invention.

FIG. 1 depicts a configuration of the valve operating device on an exhaust side according to this embodiment. A cylinder head (not illustrated) includes two exhaust valves A for each of first to fourth cylinders $\mathbf{1}_1$ to $\mathbf{1}_4$, for a total of eight exhaust valves A, and return springs B for biasing the exhaust valves A in a closing direction. A camshaft 2 for opening the respective exhaust valves A against the biasing forces of the return springs B via rocker arms C is provided in an upper part of the cylinder head.

The camshaft 2 is rotatably supported by bearings F including vertical wall parts D provided at central positions of the respective cylinders $\mathbf{1}_1$ to $\mathbf{1}_4$ of the cylinder head, and cap members E attached on the respective vertical wall parts D. The camshaft 2 is rotatably driven by a crankshaft (not illustrated) via a chain.

Moreover, the camshaft 2 includes a shaft 10 and first to fourth cam elements $\mathbf{20}_1$ to $\mathbf{20}_4$ spline-fitted onto the shaft 10 and which integrally rotate with the shaft 10 and move in axial directions along the shaft. The cam elements $\mathbf{20}_1$ to $\mathbf{20}_4$ are arranged substantially in a line on the shaft 10 to correspond to the respective cylinders $\mathbf{1}_1$ to $\mathbf{1}_4$.

Further, five electromagnetic control devices $\mathbf{30}_1$ to $\mathbf{30}_5$ for moving the respective cam elements $\mathbf{20}_1$ to $\mathbf{20}_4$ on the shaft 10 by predetermined strokes are provided. When the first cylinder $\mathbf{1}_1$ is on the front side in the cylinder row, the first control device $\mathbf{30}_1$ is disposed at a front end position of the cylinder row, the second control device $\mathbf{30}_2$ is disposed at a position between the first and second cylinders, the third control device $\mathbf{30}_3$ is disposed at a position between the second and third cylinders, the fourth control device $\mathbf{30}_4$ is disposed at a position between the third and fourth cylinders, and the fifth control device $\mathbf{30}_5$ is disposed at a rear end position of the cylinder row.

Figure 2:
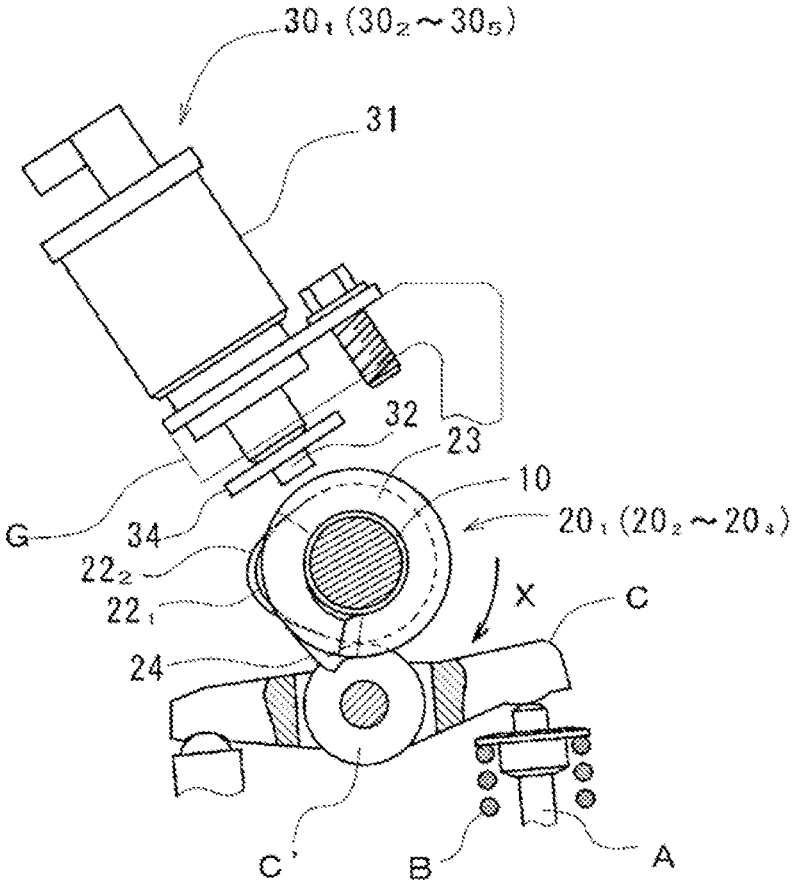
FIG. 2 is a plan view of the exhaust side valve operating device taken in an x-direction in FIG. 1.

Each of the control devices $\mathbf{30}_1$ to $\mathbf{30}_5$ includes a main body 31 and a pin part 32 serving as a control member for moving from a non-actuated position retracted into the main body 31 to an actuated position projecting from the main body 31 during power distribution thereto. As illustrated in FIG. 2, each of the control devices $\mathbf{30}_1$ to $\mathbf{30}_5$ is arranged at a predetermined angle (e.g., 30°) in a direction opposite a rotating direction X from a position opposite a cam follower C' of the rocker arm C with respect to the camshaft 2 therebetween, so that the pin part 32 is oriented toward an axial center of the camshaft 2. In this embodiment, each of the control devices $\mathbf{30}_1$ to $\mathbf{30}_5$ is attached to a pedestal G integrally formed with the cap member E constituting the bearing F.

Figure 3:
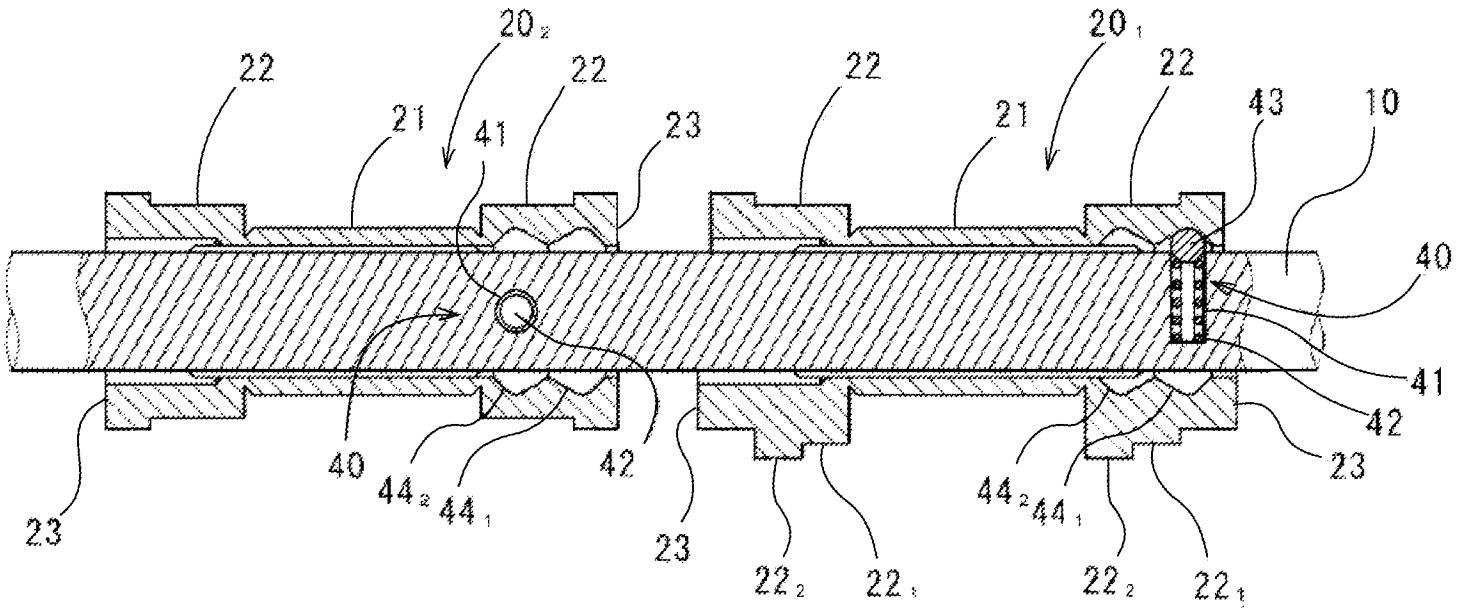
FIG. 3 is an enlarged cross-sectional view taken along a line y-y in FIG. 1.

Moreover, in order to define the movements in the axial directions of the respective cam elements $\mathbf{20}_1$ to $\mathbf{20}_4$ by the control devices $\mathbf{30}_1$ to $\mathbf{30}_5$ at two predetermined positions, detent mechanisms 40 are provided at fitted parts of the shaft 10 for the respective cam elements $\mathbf{20}_1$ to $\mathbf{20}_4$ as illustrated in FIG. 3 by taking the first and second cam elements $\mathbf{20}_1$ and $\mathbf{20}_2$ as examples.

Each detent mechanism 40 includes a hole 41 formed radially inward from the outer circumferential face of the shaft 10, a spring 42 accommodated in the hole 41, a detent ball 43 disposed at an opening of the hole 41 and biased by the spring 42 such as to eject radially outward from the outer circumferential face of the shaft 10, and two circumferential grooves $\mathbf{44}_1$ and $\mathbf{44}_2$ formed adjacent to each other in the axial directions in the inner circumferential face of the corresponding cam element ($\mathbf{20}_1$ to $\mathbf{20}_4$). When the detent ball 43 is engaged by one of the circumferential grooves ($\mathbf{44}_1$ in this embodiment), the corresponding cam element ($\mathbf{20}_1$ to $\mathbf{20}_4$) is positioned at a first position illustrated in FIG. 1, and when the detent ball 43 is engaged by the other circumferential groove ($\mathbf{44}_2$ in this embodiment), the corresponding cam element ($\mathbf{20}_1$ to $\mathbf{20}_4$) is positioned at a second position illustrated in FIG. 4.

Here, as illustrated in FIG. 1, when all of the first to fourth cam elements $\mathbf{20}_1$ to $\mathbf{20}_4$ are at the respective first positions, the first cam element $\mathbf{20}_1$ is positioned at a rearward position, the second cam element $\mathbf{20}_2$ is positioned at a forward position, the third cam element $\mathbf{20}_3$ is positioned a rearward position, and the fourth cam element $\mathbf{20}_4$ is positioned at a forward position. Therefore, opposing end faces of the first and second cam elements $\mathbf{20}_1$ and $\mathbf{20}_2$ are close to each other, opposing end faces of the second and third cam elements $\mathbf{20}_2$ and $\mathbf{20}_3$ are far from each other, and opposing end faces of the third and fourth cam elements $\mathbf{20}_3$ and $\mathbf{20}_4$ are close to each other.

Figure 4:
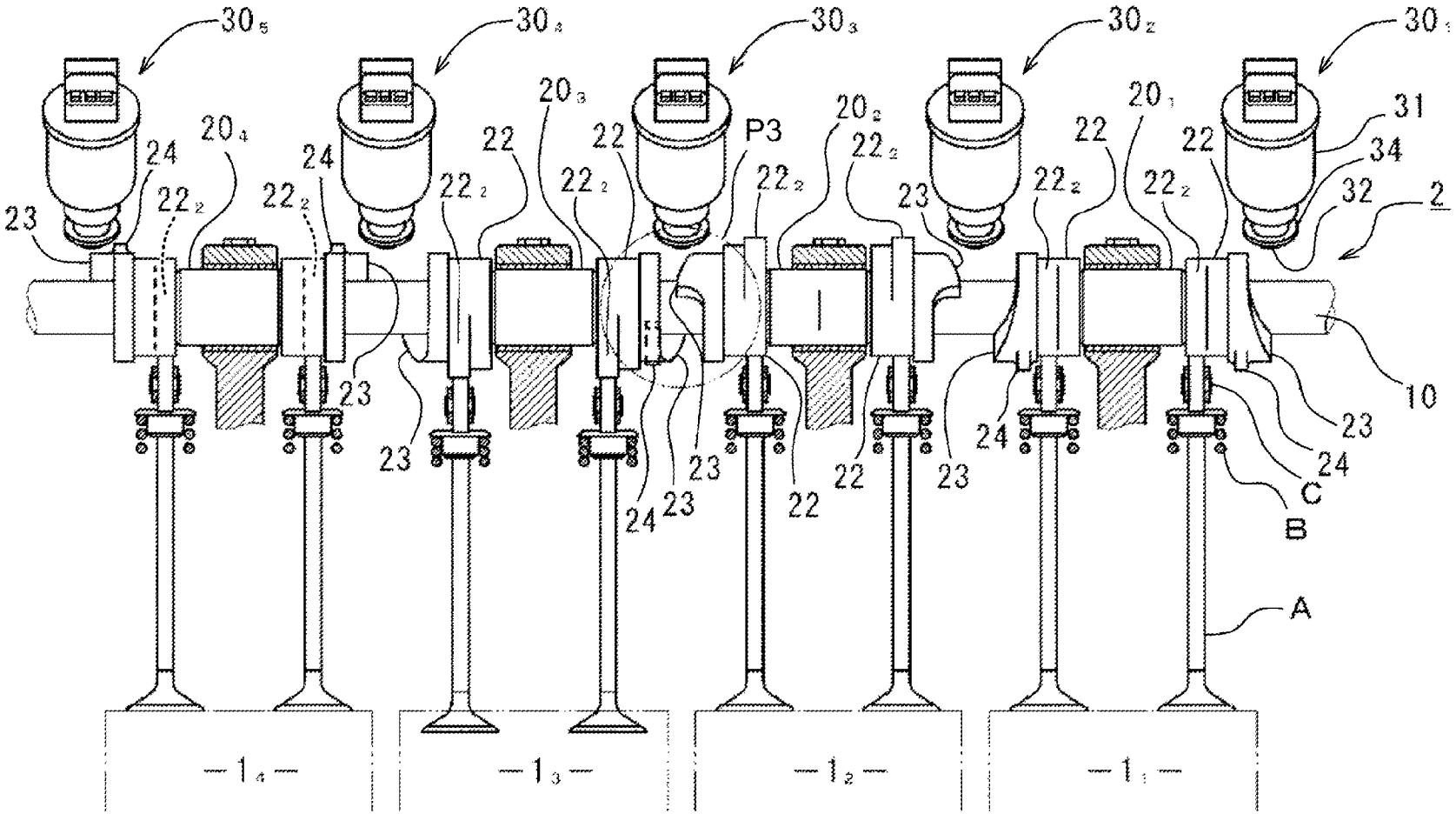
FIG. 4 is a side view illustrating the exhaust side valve operating device in a state where cam parts for operating valves are switched from the state in FIG. 1.

Moreover, as illustrated in FIG. 4, when all of the first to fourth cam elements $\mathbf{20}_1$ to $\mathbf{20}_4$ are at the respective second positions, the first cam element $\mathbf{20}_1$ is positioned forward, the second cam element $\mathbf{20}_2$ is positioned rearward, the third cam element $\mathbf{20}_3$ is positioned forward, and the fourth cam element $\mathbf{20}_4$ is positioned rearward. Here, the opposing end faces of the first and second cam elements $\mathbf{20}_1$ and $\mathbf{20}_2$ are far from each other, the opposing end faces of the second and third cam elements $\mathbf{20}_2$ and $\mathbf{20}_3$ are close to each other, and the opposing end faces of the third and fourth cam elements $\mathbf{20}_3$ and $\mathbf{20}_4$ are far from each other.

Figure 5:
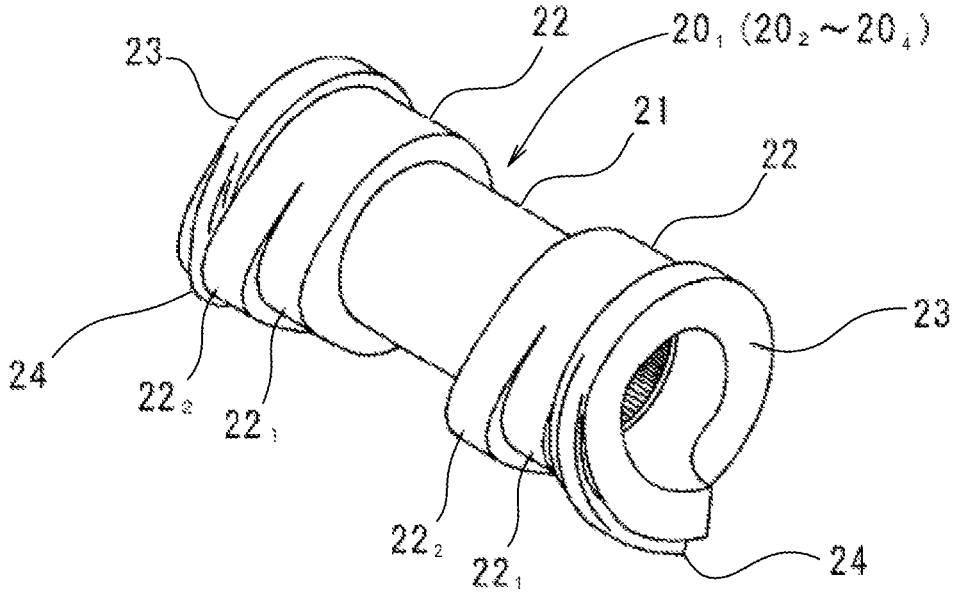
FIG. 5 is a single perspective view of a cam element.
Figure 6:
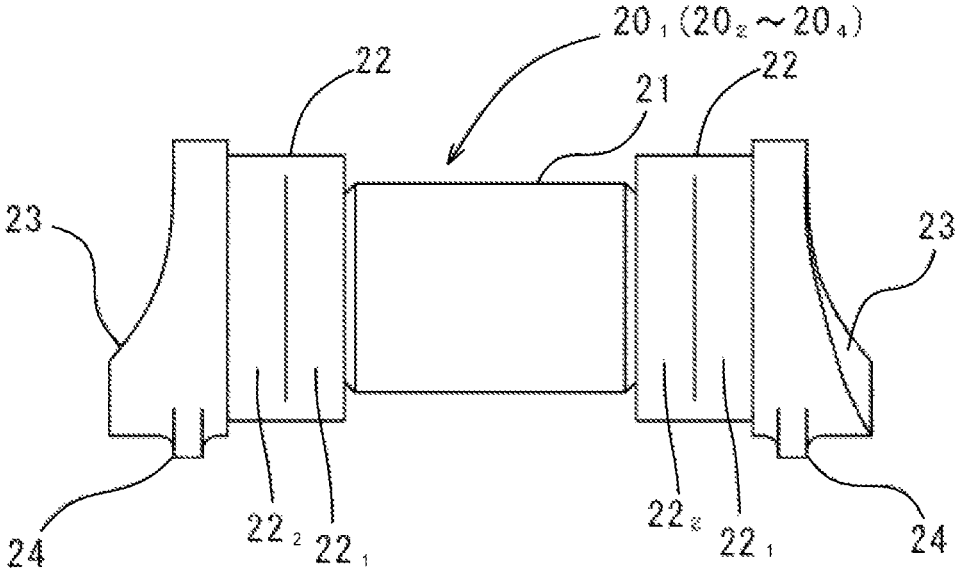
FIG. 6 is a side view of the cam element.
Figure 7:
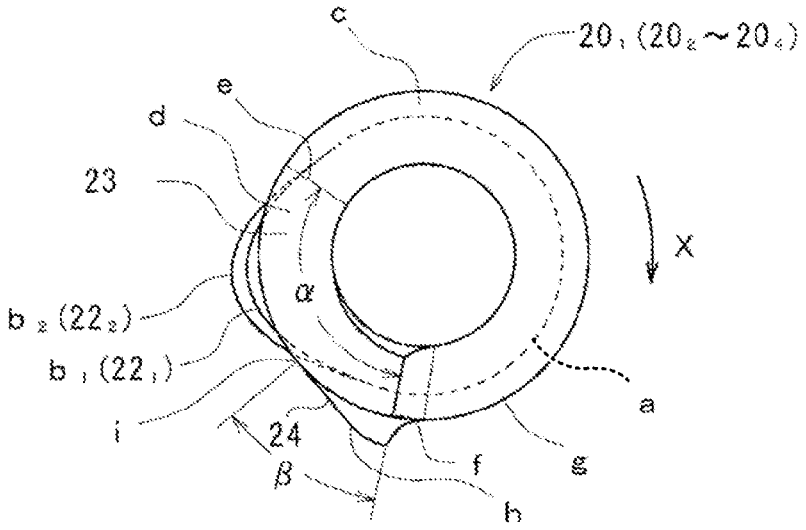
FIG. 7 is a plan view of the cam element.

Next, the configuration of the cam elements $\mathbf{20}_1$ to $\mathbf{20}_4$ is described in further detail by taking the first cam element $\mathbf{20}_1$ as an example, with reference to FIGS. 5 to 7.

The first cam element $\mathbf{20}_1$ ($\mathbf{20}_2$ to $\mathbf{20}_4$) is formed cylindrically. The outer circumferential face of an intermediate part thereof serves as a journal face 21 supported by the bearing part F, and operating parts 22 for the two respective exhaust valves A of the cylinder are provided on front and rear sides of the journal face 21, respectively. Each operating part 22 is provided with a first cam part $\mathbf{22}_1$ used for, for example, a low engine speed and having a low lift and a second cam part $\mathbf{22}_2$ used for, for example, a high engine speed and having a high lift. The first and second cam parts $\mathbf{22}_1$ and $\mathbf{22}_2$ are disposed adjacent to each other.

As illustrated in FIG. 7, the first and second cam parts $\mathbf{22}_1$ and $\mathbf{22}_2$ have a common base circle a and respective nose parts $b_1$ and $b_2$ with different lifts but matched phases on the base circle a. Further, the first and second cam parts $\mathbf{22}_1$ and $\mathbf{22}_2$ are provided such that the arrangement thereof in the front-and-rear directions and the phases of the nose parts $b_1$ and $b_2$ are uniformed between the two operating parts 22.

In this case, as illustrated in FIGS. 1 and 4, in each of the first and third cam elements $\mathbf{20}_1$ and $\mathbf{20}_3$, the first cam part $\mathbf{22}_1$ is disposed forward and the second cam part $\mathbf{22}_2$ is disposed rearward, and in each of the second and fourth cam elements $20_2$ and $20_4$, the second cam part $22_2$ is disposed forward and the first cam part $22_1$ is disposed rearward.

Further, when the cam elements $20_1$ to $20_4$ are positioned at the respective first positions on the shaft 10 by the detent mechanisms 40, in each of the cam elements $20_1$ to $20_4$, the positions of the two first cam parts $22_1$ correspond to (are located right above) the two cam followers C' of the rocker arms C of the corresponding cylinder (see FIG. 1), and when the cam elements $20_1$ to $20_4$ are positioned at the respective second positions on the shaft 10, in each of the cam elements $20_1$ to $20_4$, the positions of the two second cam parts $22_2$ correspond to (are located right above) the two cam followers C' (see FIG. 4).

Here, in the engine of this embodiment, the combustion order of the cylinders is the first cylinder $1_1$, the third cylinder $1_3$, the fourth cylinder $1_4$, and then the second cylinder $1_2$. The first to fourth cam elements $20_1$ to $20_4$ are offset in phase and are spline-fitted onto the shaft 10, so that the positions of the nose parts $b_1$ of the first cam parts $22_1$ or the nose parts $b_2$ of the second cam parts $22_2$ of each of the respective cam elements $20_1$ to $20_4$ corresponds to the cam followers C' in the combustion order every time the camshaft 2 rotates by 90°.

Further, each of the cam elements $20_1$ to $20_4$ is formed with end face cams 23 at its front and rear ends.

As illustrated in FIGS. 5 to 7, the end face cams 23 at both front and rear ends have protruding portions d protruding forward and rearward respectively in an axial direction of the cam element $20_1$ ($20_2$ to $20_4$) from reference surfaces c symmetrically with respect to the cross section including the center of the cam element $20_1$ ($20_2$ to $20_4$) in the axial direction. As illustrated in FIG. 7, within a predetermined angle range $\alpha$ (e.g., 120°) from a protrusion start position e to a protrusion end position f, the amount that each protruding portion d protrudes from the reference surface c in the corresponding axial direction increases gradually in the rotating direction X and returns to zero (the protruding portion ends and returns to the reference surface c) at the protrusion end position f.

Moreover, since the cam elements $20_1$ to $20_4$ are spline-fitted onto the shaft 10 with predetermined phase differences from each other according to the combustion order of the respective cylinders $1_1$ to $1_4$ as described above, the opposing end face cams 23 of the respective cam elements $20_1$ to $20_4$ also have phase differences with each other. Thus, as indicated by "P1" and "P2" in FIG. 1 and "P3" in FIG. 4, when the adjacent cam elements are close to each other, the protruding portions d of the opposing end face cams 23 therebetween overlap with each other in the axial directions.

Further, in the state where the protruding portions d of the opposing end face cams 23 of the corresponding two cam elements overlap with each other, each of the pin parts 32 of the second to fourth control devices $30_2$ to $30_4$ are projected to the actuated position to engage with the opposing end face cams 23. Thus, the pin part 32 slides the two cam elements, which are close to each other, to separate them according to the rotation of the camshaft 2.

Here, in the state illustrated in FIG. 1, the first and second cam elements $20_1$ and $20_2$ move from the respective first positions to the respective second positions illustrated in FIG. 4 by being separated from each other, and the third and fourth cam elements $20_3$ and $20_4$ move from the respective first positions to the respective second positions illustrated in FIG. 4 by being separated from each other. Moreover, in the state illustrated in FIG. 4, the second and third cam elements $20_2$ and $20_3$ move from the respective second positions to the respective first positions illustrated in FIG. 1 by being separated from each other.

On the other hand, in the state where the first cam element $20_1$ is at the second position which is the forward position as illustrated in FIG. 4, the pin part 32 of the first control device $30_1$ is projected to the actuated position to engage with the front end face cam 23 of the first cam element $20_k$. Thus, the pin part 32 of the control device $30_1$ moves the first cam element $20_1$ to the first position which is the rearward position, according to the rotation of the camshaft 2. Similarly, in the state where the fourth cam element $20_4$ is at the second position which is the rearward position, the pin part 32 of the fifth control device $30_5$ is projected to the actuated position to engage with the rear end face cam 23 of the fourth cam element $20_4$. Thus, the pin part 32 of the fifth control device $30_5$ moves the fourth cam element $20_4$ to the first position which is the forward position.

Here, the pin parts 32 of the first and fifth control devices $30_1$ and $30_5$ need to be projected to the actuated positions at a timing at which the reference surface c of the front end face cam 23 of the first cam element $20_1$ is on the same side in a circumferential direction of the shaft as an oriented position (actuated position) of the corresponding pin part 32 and adjacent in the axial directions to the oriented position and a timing at which the reference surface c of the rear end face cam 23 of the fourth cam element $20_4$ is on the same side in the circumferential direction as an oriented position (actuated position) of the corresponding pin part 32 and adjacent in the axial directions to the oriented position, respectively. The pin parts 32 of the second to fourth control devices $30_2$ to $30_4$ need to be projected to the actuated positions at respective timings at which both reference surfaces c of the two opposing end face cams 23 are on the same side in the circumferential direction of the shaft as an oriented position (actuated position) of the corresponding pin part 32 and adjacent in the axial directions to the oriented position.

Moreover, each of the movements of the cam elements $20_1$ to $20_4$ by projecting the pin parts 32 to the actuated positions needs to be performed at a timing at which the position of the cam follower C' of the rocker arm C corresponds to the base circle a of the first cam part $22_1$ and a timing at which the position of the cam follower C' of the rocker arm C corresponds to the base circle a of the second cam part $22_2$, in other words, at a timing at which the corresponding cylinder is not on an exhaust stroke.

Therefore, to satisfy the conditions of the operation timings, as illustrated in FIG. 7, the start position e of the protruding portion d of the end face cam 23 is set to a position at a predetermined angle to the rotating direction X from the top of the nose parts $b_1$ and $b_2$ of the first and second cam parts $22_1$ and $22_2$, and the end position f of the protruding portion d of the end face cam 23 is set to a position at a predetermined angle from the top to the side opposite the rotating direction X. Thus, the nose parts $b_1$ and $b_2$ of the first and second cam parts $22_1$ and $22_2$ are in a positional relationship to the protruding portion d of the end face cam 23 such that they overlap with each other. In this case, based on the positional relationship of the cam follower C' of the rocker arm C with the pin parts 32 of the control devices $30_1$ to $30_5$ as illustrated in FIG. 2, the respective cam elements $20_1$ to $20_4$ move immediately after the exhaust stroke ends.

Further, as illustrated in FIGS. 6 and 7, slopes 24 for forcibly moving the pin parts 32, from the respective actuated positions of the control devices $30_1$ and $30_2$ to the respective non-actuated positions, are formed in the outer circumferential faces of the end face cams 23 formed in both front and rear end faces of the cam element $20_1$. Each slope 24 has a protruding portion h protruding in a radial direction of the end face cam 23 from a reference surface g of the outer circumferential face of the end face cam, and as illustrated in FIG. 7, within a range from a start position i of the slope to the end position f of the end face cam 23, the amount protruding gradually increases from zero and returns to zero (the protruding portion ends and returns to the reference surface g) at the end position f. The start position i of the slope is a position at a predetermined angle β (e.g., 30°) from the end position f of the end face cam 23 to the side opposite the rotating direction X.

The slopes 24 are only formed in the circumferential face of the end face cams 23 of a specific cam element to make a pair with the respective first to fifth control devices $\mathbf{30}_1$ to $\mathbf{30}_5$. The slopes 24, after the cam elements $\mathbf{20}_1$ to $\mathbf{20}_4$ to which the control devices $\mathbf{30}_1$ to $\mathbf{30}_5$ correspond are respectively moved, forcibly move the pin parts 32 toward the main bodies 31. Specifically, each of the slopes 24 respectively facing the pin parts 32 of the second to fourth control devices $\mathbf{30}_2$ to $\mathbf{30}_4$ which are disposed between the cylinders is formed in the outer circumferential face of the end face cam 23 of one of the adjacent cam elements which is separated later than the other end face cam 23 by the same pin part 32. Whereas, each of the slopes 24 respectively facing the pin parts 32 of the control devices $\mathbf{30}_1$ and $\mathbf{30}_5$ which are respectively disposed at the front end position and the rear end position of the cylinder row are provided is formed in the outer circumferential face of the end face cam 23.

In this embodiment, according to the combustion order, starting from the cylinder where the exhaust stroke has ended, the switch operation is performed on the corresponding cam element. For example, when switching from the first position to the second position, first, the second control device $\mathbf{30}_2$ moves the second cam element $\mathbf{20}_2$ to the rearward position and then moves the first cam element $\mathbf{20}_1$ to the forward position, and then the fourth control device $\mathbf{30}_4$ moves the third cam element $\mathbf{20}_3$ to the forward position and then moves the fourth cam element $\mathbf{20}_4$ to the rearward position.

Moreover, when switching from the second position to the first position, first, the third control device $\mathbf{30}_3$ moves the second cam element $\mathbf{20}_2$ to the forward position, next, the first control device $\mathbf{30}_1$ moves the first cam element $\mathbf{20}_1$ to the rearward position, then the third control device $\mathbf{30}_3$ moves the third cam element $\mathbf{20}_3$ to the rearward position, and then the fifth control device $\mathbf{30}_5$ moves the fourth cam element $\mathbf{20}_4$ to the forward position.

In other words, the slope 24 corresponding to the first control device $\mathbf{30}_1$ is formed in the outer circumferential face of the front end face cam 23 of the first cam element $\mathbf{20}_1$, the slope 24 corresponding to the second control device $\mathbf{30}_2$ is formed in the outer circumferential face of the rear end face cam 23 of the first cam element $\mathbf{20}_1$, the slope 24 corresponding to the third control device $\mathbf{30}_3$ is formed in the outer circumferential face of the front end face cam 23 of the third cam element $\mathbf{20}_3$, the slope 24 corresponding to the fourth control device $\mathbf{30}_4$ is formed in the outer circumferential face of the front end face cam 23 of the fourth cam element $\mathbf{20}_4$, and the slope 24 corresponding to the fifth control device $\mathbf{30}_5$ is formed in the outer circumferential face of the rear end face cam 23 of the fourth cam element $\mathbf{20}_4$.

Next, the configuration of the control devices $\mathbf{30}_1$ to $\mathbf{30}_5$ is described in detail with reference to FIG. 8 by taking the first control device $\mathbf{30}_1$ as an example. Part (A) of FIG. 8 is a partial cross-sectional view illustrating a state where the pin part 32 of the first control device $\mathbf{30}_1$ is kept at the non-actuated position, and part (B) of FIG. 8 is a partial cross-sectional view illustrating a state where the pin part 32 of the first control device $\mathbf{30}_1$ is kept at the actuated position.

Figure 8:
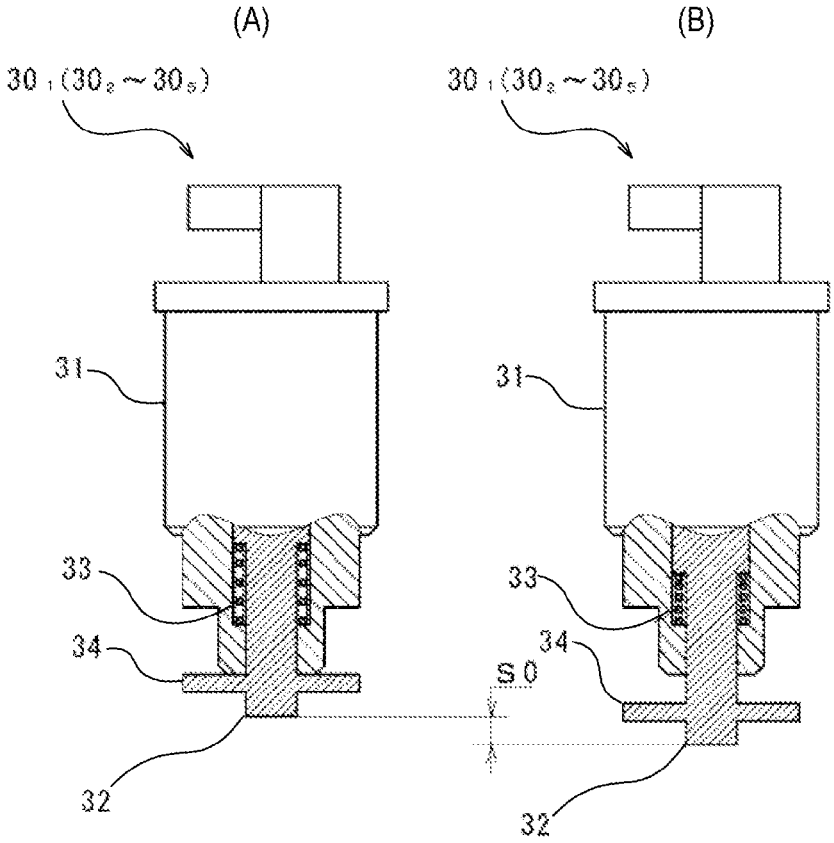
FIG. 8 is a partial cross-sectional view of a control device.

As illustrated in FIG. 8, the pin part 32 of the first control device $\mathbf{30}_1$ is biased toward the main body 31 by a return spring 33. In a state of no power distribution, as illustrated in part (A), the pin part 32 is kept at the non-actuated position by the return spring 33. On the other hand, as illustrated in part (B), as power is distributed to the pin part 32, an electromagnetic actuator (not illustrated) moves the pin part 32 against the force of the return spring 33, to the actuated position protruding toward the axial center of the camshaft 2 by a movement amount S0.

The power distributions to the control devices $\mathbf{30}_1$ to $\mathbf{30}_5$ are performed by power distribution instructions to the control devices $\mathbf{30}_1$ to $\mathbf{30}_5$ from a computer (not illustrated) at predetermined engine speed timings detected by a sensor (not illustrated). In other words, the sensor for detecting the engine speed, the computer for performing the power distribution instructions to the control devices $\mathbf{30}_1$ to $\mathbf{30}_5$ at the predetermined engine speed timings, the electromagnetic actuators, and the return springs 33 cooperate with each other to serve as an operating mechanism for moving the pin parts 32 of the control devices $\mathbf{30}_1$ to $\mathbf{30}_5$ to the respective actuated positions at the predetermined engine speed timings and keeping, at the respective non-actuated position, the pin parts 32 forcibly moved to the non-actuated positions by the slopes 24.

Moreover, a contact part 34 having a circular plate-like shape is provided to each pin part 32, and the contact part 34 is arranged such that it, at the non-actuated position, does not interfere with the end face cam 23 and the slope 24 and, at the actuated position, slides while in contact with the slope 24 while securing a gap with a part of the outer circumferential face of the end face cam 23 other than the slope 24. Moreover, the size of the contact part 34 is large enough to slide while in contact with the slope 24 provided to the cam element $\mathbf{20}_1$ in both cases where the cam element $\mathbf{20}_1$ is at the first position and the second position.

Next, the operations in which the slopes 24 forcibly move the pin parts 32 of the control devices $\mathbf{30}_1$ to $\mathbf{30}_5$ toward the respective non-actuated positions are described with reference to FIGS. 9A to 9D by taking the slope 24 formed on the front side of the first cam element $\mathbf{20}_1$ as an example. FIGS. 9A to 9D are plan views taken along the x-direction in FIG. 1, which illustrate a main part in the operation in which the slope 24 forcibly moves the pin part 32 toward the non-actuated position after the pin part 32 of the first control device $\mathbf{30}_1$ moves the first cam element $\mathbf{20}_1$ from the second position to the first position.

Figure 9A:
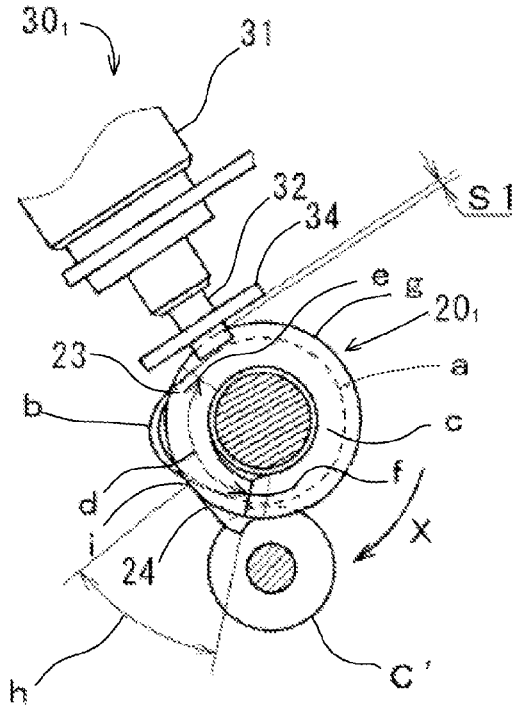
FIGS. 9A to 9D are plan views taken along the x-direction in FIG. 1, which illustrate a main part in an operation in which a slope forcibly moves a control member toward a non-actuated position.

FIG. 9A illustrates the end of the exhaust stroke in the first cylinder $\mathbf{1}_1$, in which the state where the contacting section between the second cam part $\mathbf{22}_2$ of the first cam element $\mathbf{20}_1$ and the cam follower C' corresponds to the base circle a is illustrated. Here, the first control device $\mathbf{30}_1$ is distributed with the power and the pin part 32 is at the actuated position protruding toward the axial center of the camshaft 2. In this state, a gap S1 is secured between the contact part 34 provided to the pin part 32 and the outer circumferential face of the end face cam 23.

Figure 9B:
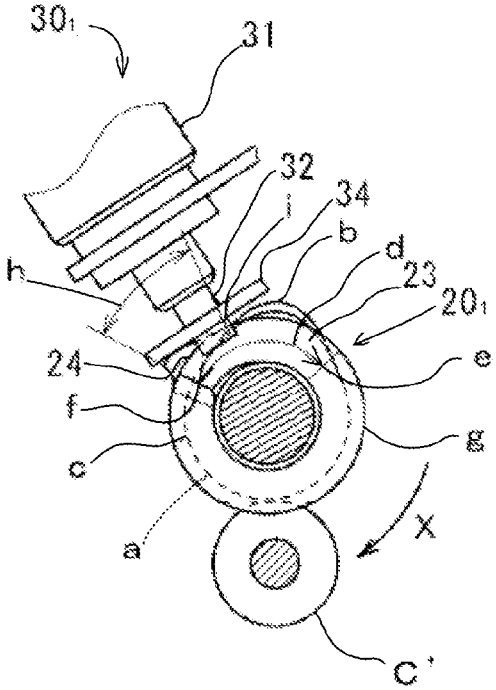

Further, as the camshaft 2 rotates, as illustrated in FIG. 9B, the cam element $\mathbf{20}_1$ starts moving toward the rear position due to the engagement between the pin part 32 and the end face cam 23, and then as the camshaft 2 further rotates, the slope 24 slides while in contact with the contact part 34. Note that, since the size of the contact part 34 is large enough to slide while in contact with the slope 24 formed in the first cam element $\mathbf{20}_1$ in both cases where the cam element $\mathbf{20}_1$ is at the first position and the second position as described above, regardless of the position (the front position or the rear position) of the first cam element $20_1$, the slope 24 surely contacts with the contact part 34.

Here, the power distribution to the first control device $30_1$ is stopped, and the pin part 32 starts moving to the non-actuated position by the biasing force of the return spring 33.

Figure 9C:
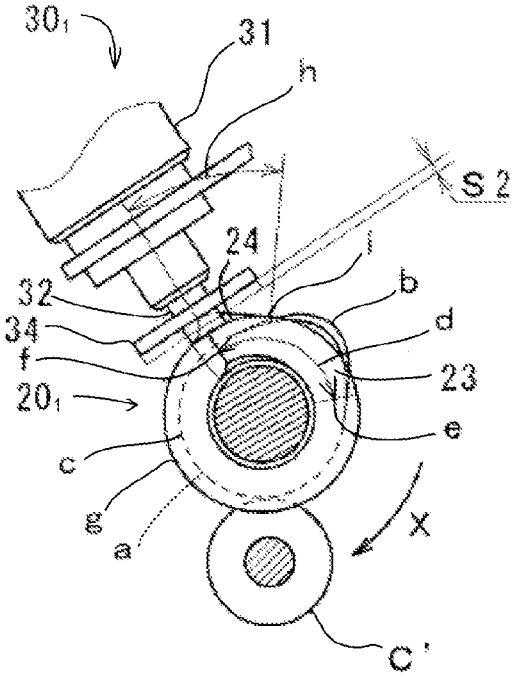

Further, by the rotation of the camshaft 2, as illustrated in FIG. 9C, the slope 24 pushes the contact part 34 upward to separate the contact part 34 from the axial center of the camshaft 2 by a movement amount S2. In other words, the pin part 32 is forcibly moved in the direction of being separated from the axial center of the camshaft 2 by the movement amount S2. The movement amount S2 corresponds to an amount obtained by subtracting the amount of the gap S1 between the contact part 34 of the pin part 32 at the actuated position and the outer circumferential face of the end face cam 23 from the maximum protruding amount S0 of the slope 24 (movement amount S0).

Figure 9D:
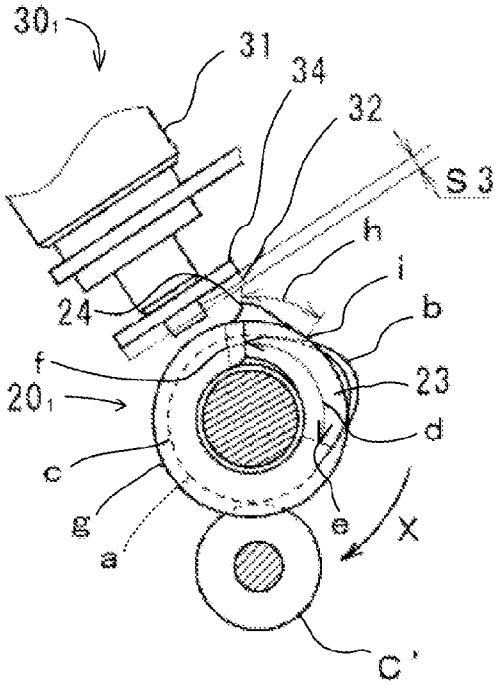

Then, as illustrated in FIG. 9D, the pin part 32 is pushed further upward by the return spring 33 and kept at the non-actuated position. As a result, while the camshaft 2 fully rotates once (360°), the pin part 32 of the first control device $30_1$ is forcibly moved to the non-actuated position while the pin part 32 acts on the end face cam 23 to move the first cam element $20_1$ to the rear position, in other words, the switch operation from the second cam part $22_2$ to the first cam part $22_1$ is performed.

That is, since the switch operation from the second cam part $22_2$ to the first cam part $22_1$ surely ends and the forcible movement of the pin part 32 to the main body 31 completes while the camshaft 2 fully rotates once, the second cam part $22_2$ can be switched to the first cam part $22_1$ subsequently in the next combustion cycle. Specifically, even if the first cam element $20_1$ is moved to the front position by moving the pin part 32 of the second device $20_2$ located rearward of the first cam element $20_1$, to the actuated position when the next exhaust stroke ends, since the pin part 32 of the first control device $30_1$ located forward of the first cam element is kept at the non-actuated position, interference between the pin part 32 of the first control device $30_1$ and the first cam element $20_1$ moved to the second position can surely be prevented.

Therefore, according to this embodiment, the switch operation of the cam can be performed successively and instantaneously by surely preventing interference between the pin parts 32 of the control devices $30_1$ to $30_5$ and the respective cam elements $20_1$ to $20_4$. Moreover, since only the projection of the pin part 32 of the control device is performed by the power distribution and the retreating operation of the pin part 32 to the main body 31 is achieved by the slope 24 and the return spring 33 (i.e., the control device is structured simply to be a single-acting control device), the increase in size of the respective control devices $30_1$ to $30_5$ is avoided and the ease of installation of the control devices in the engine can be secured.

Next, the operation of this embodiment is described.

Firstly, as illustrated in FIG. 1, for example, when the engine is operated in low speed and the first to fourth cam elements $20_1$ to $20_4$ are positioned at the respective first positions, in each of the cam elements $20_1$ to $20_4$, the positions of the first cam parts $22_1$ with the low lift in the operating parts 22 in both end sections correspond to the cam followers C' of the rocker arms C, and the exhaust valves A of each of the cylinders $1_1$ to $1_4$ open to a relatively small degree on the exhaust stroke in the combustion order, according to the rotation of the camshaft 2.

When switching from this state to a state where the opening degree of the exhaust valves A is larger due to, for example, an increase in the engine speed, the switch operation is performed by distributing power to the second and fourth control devices $30_2$ and $30_4$ to project the pin parts 32 from the respective non-actuated position to the respective actuated position.

Figure 10A:
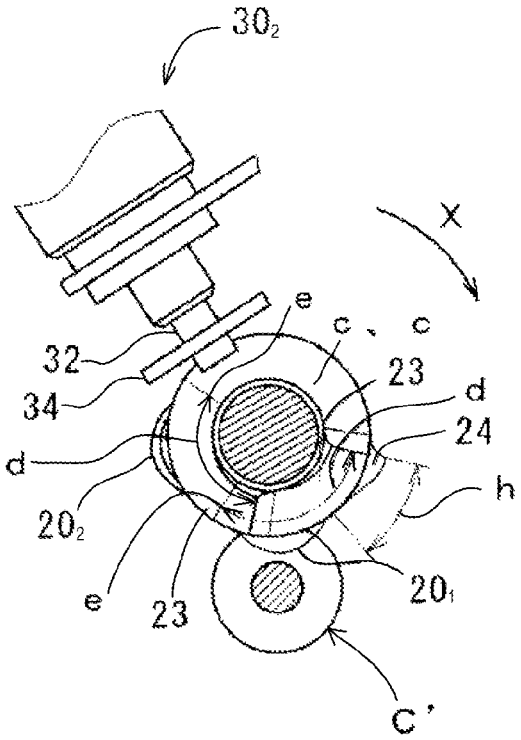
FIG. 10A is a plan view taken along a line x2-x2 in FIG. 1, which illustrates a main part in an operation for switching the cam part for opening and closing the valve from a first cam part to a second cam part.

Specifically, first, the pin part 32 of the second control device $30_2$ is projected to the position between the opposing end face cams 23 of the first and second cam elements $20_1$ and $20_2$ which are close to each other at the respective first positions, and the pin part 32 engages with the end face cams 23 of which the protruding portions d overlap with each other in the axial directions. In this case, as illustrated in FIG. 10A, the pin part 32 of the second control device $30_2$ is projected in a period in which the reference surfaces c of the first and second cam elements $20_1$ and $20_2$ where the protruding amounts of the opposing end face cams 23 thereof are both zero, are on the same side in the circumferential direction as the oriented positions and adjacent in the axial directions to the oriented positions.

Then, after the exhaust stroke of the second cylinder $1_2$ ends, the protrusion start position e of the front end face cam 23 of the second cam element $20_2$ indicated by the solid line reaches the position of the pin part 32 of the second control device $30_2$, and then, the pin part 32 pushes the second cam element $20_2$ rearward to reach the second position while sliding in contact with the protruding portion d of the end face cam 23 according to the rotation of the camshaft 2.

Moreover, after the protrusion start position e of the end face cam 23 of the second cam element $20_2$ reaches the position of the pin part 32, the camshaft 2 rotates 90° and the exhaust stroke of the first cylinder $1_1$ ends, and then, the protrusion start position e of the rear end face cam 23 of the first cam element $20_1$ indicated by the dotted line reaches the position of the pin part 32. Thereafter, the pin part 32 pushes the first cam element $20_1$ forward to reach the second position while sliding in contact with the protruding portion d of the end face cam 23 according to the rotation of the camshaft 2.

Further, the start position i of the slope 24 formed in the outer circumferential face of the rear end face cam 23 of the first cam element $20_1$ reaches the position of the pin part 32 of the second control device $30_2$. Here, the power distribution to the second control device $30_2$ is stopped and the pin part 32 starts moving to the non-actuated position by the return spring 33. The protruding portion h of the slope 24 of the first cam element $20_1$ forcibly moves the pin part 32 to the non-actuated position while sliding in contact with the pin part 32, according to the rotation of the camshaft 2. Then, the pin part 32 is kept at the non-actuated position by the return spring 33.

Figure 10B:
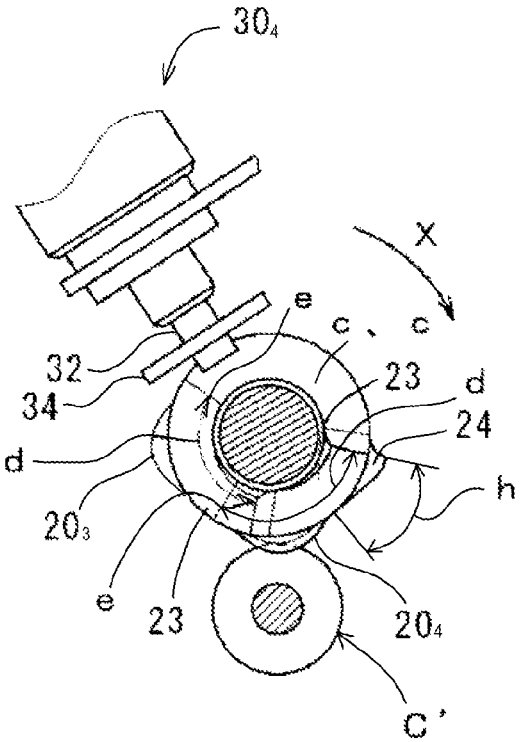
FIG. 10B is a plan view taken along a line x4-x4 in FIG. 1, which illustrates a main part in an operation for switching the cam part for opening and closing the valve from a first cam part to a second cam part.

Next, as illustrated in FIG. 10B, the pin part 32 of the fourth control device $30_4$ is projected to the position between the opposing end face cams 23 of the third and fourth cam elements $20_3$ and $20_4$ which are close to each other at the respective first positions, and the pin part 32 engages with the end face cams 23 of which the protruding portions d overlap with each other in the axial directions. In this case, the pin part 32 is projected in a period in which the reference surfaces c of the third and fourth cam elements $20_3$ and $20_4$ where the protruding amounts of the opposing end face cams 23 thereof are both zero, are on the same side in the circumferential direction as the oriented positions and adjacent in the axial directions to the oriented positions.

Then, after the exhaust stroke of the third cylinder $1_3$ ends, the protrusion start position e of the rear end face cam 23 of the third cam element $20_3$ indicated by the dotted line reaches the position of the pin part 32 of the fourth control device $30_4$, and the pin part 32 pushes the third cam element $20_3$ forward to reach the second position while sliding in contact with the protruding portion d of the end face cam 23 according to the rotation of the camshaft 2.

Moreover, after the protrusion start position e of the end face cam 23 of the third cam element $\mathbf{20}_3$ reaches the position of the pin part 32, the camshaft rotates 90° and the exhaust stroke of the fourth cylinder $\mathbf{1}_4$ ends, and then, the protrusion start position e of the front end face cam 23 of the fourth cam element $\mathbf{20}_4$ indicated by the solid line reaches the position of the pin part 32. Thereafter, the pin part 32 pushes the fourth cam element $\mathbf{20}_4$ rearward to reach the second position while sliding in contact with the protruding portion d of the end face cam 23 according to the rotation of the camshaft 2.

Further, the start position i of the slope 24 formed in the outer circumferential face of the front end face cam 23 of the fourth cam element $\mathbf{20}_4$ reaches the position of the pin part 32 of the fourth control device $\mathbf{30}_4$. Here, the power distribution to the fourth control device $\mathbf{30}_4$ is stopped and the pin part 32 starts moving to the non-actuated position by the return spring 33. Then, the protruding portion h of the slope 24 of the fourth cam element $\mathbf{20}_4$ acts to forcibly move the pin part 32 to the non-actuated position while sliding in contact with the pin part 32, according to the rotation of the camshaft 2. The pin part 32 is then kept at the non-actuated position by the return spring 33.

As described above, all the first to fourth cam elements $\mathbf{20}_1$ to $\mathbf{20}_4$ move from the respective first positions to the respective second positions, and as illustrated in FIG. 4, in all the first to fourth cam elements $\mathbf{20}_1$ to $\mathbf{20}_4$, the positions of the second cam parts $\mathbf{22}_2$ of the operating parts 22 in both end sections correspond to the cam followers C' of the rocker arms C, and the exhaust valves A of the respective cylinders $\mathbf{1}_1$ to $\mathbf{1}_4$ open to a relatively large degree on the exhaust stroke.

Additionally, the pin parts 32 can be kept at the non-actuated positions by surely and forcibly moving the pin parts 32 of the second and fourth control devices $\mathbf{30}_2$ and $\mathbf{30}_4$ into the main bodies 31 while moving the first to fourth cam elements $\mathbf{20}_1$ to $\mathbf{20}_4$ from the respective first positions to the respective second positions by projecting the pin parts 32 of the second and fourth control devices $\mathbf{30}_2$ and $\mathbf{30}_4$. In other words, the movements of the first to fourth cam elements $\mathbf{20}_1$ to $\mathbf{20}_4$ and the movements of the pin parts 32 of the second and fourth control devices $\mathbf{30}_2$ and $\mathbf{30}_4$ to either one of the respective actuated positions and the respective non-actuated positions complete while the camshaft fully rotates once.

On the other hand, when switching from the state illustrated in FIG. 4, where the positions of the second cam parts $\mathbf{22}_2$ having high lift in the respective cam elements $\mathbf{20}_1$ to $\mathbf{20}_4$ correspond to the cam followers C' of the rocker arms C, to a state illustrated in FIG. 1, where the positions of the first cam parts $\mathbf{22}_1$ having low lift correspond to the cam followers C' due to, for example, a decrease in engine speed, the switch operation is performed by distributing power to the first, third and fifth control devices $\mathbf{30}_k$, $\mathbf{30}_3$ and $\mathbf{30}_5$ to project the pin parts 32 thereof from the respective non-actuated positions to the respective actuated positions.

Figure 11A:
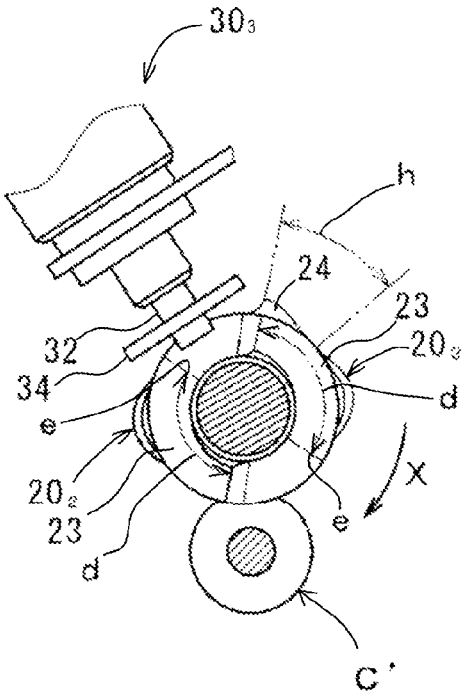
FIG. 11A is a plan view taken along a line x3-x3 in FIG. 1, which illustrates a main part in an operation for switching the cam part for opening and closing the valve from the second cam part to the first cam part.
Figure 11B:
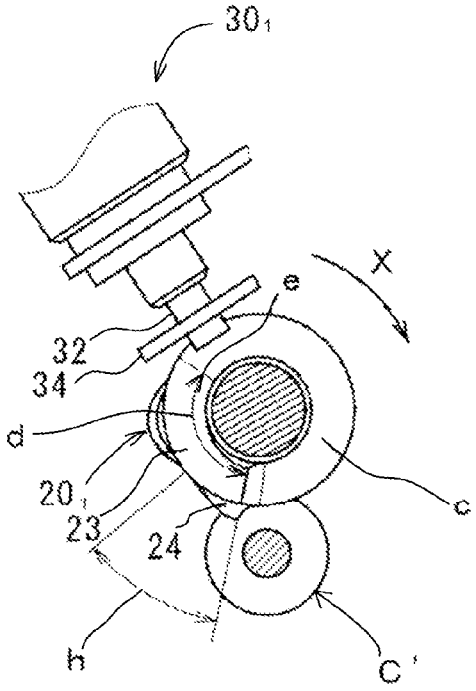
FIG. 11B is a plan view taken along a line x1-x1 in FIG. 1, which illustrates a main part in an operation for switching the cam part for opening and closing the valve from the second cam part to the first cam part.

Specifically, first, as illustrated in FIG. 11A, the pin part 32 of the third control device $\mathbf{30}_3$ is projected to a position between the opposing face cams 23 of the second and third cam elements $\mathbf{20}_2$ and $\mathbf{20}_3$. When the exhaust stroke of the second cylinder $\mathbf{1}_2$ ends, the protrusion start position e of the end face cam 23 of the second cam element $\mathbf{20}_2$ reaches the position of the pin part 32, and then, the pin part 32 pushes the second cam element $\mathbf{20}_2$ forward to reach the first position while sliding in contact with the protruding portion d according to the rotation of the camshaft 2. Next, as illustrated in FIG. 11B, in a period in which the position of the reference surface c of this end face cam 23 corresponds to the oriented position in the axial directions, the pin part 32 of the first control device $\mathbf{30}_1$ is projected to a position adjacent in the axial directions to the front end face cam 23 of the first cam element $\mathbf{20}_1$ which is at the second position, to engage with the end face cam 23.

Then, after the exhaust stroke of the first cylinder $\mathbf{1}_1$ ends, the protrusion start position e of the front end face cam 23 of the first cam element $\mathbf{20}_1$ reaches the position of the pin part 32 of the first control device $\mathbf{30}_k$, and then, the pin part 32 pushes the first cam element $\mathbf{20}_1$ rearward to reach the first position while sliding in contact with the protruding portion d of the end face cam 23 according to the rotation of the camshaft 2. That is, after sliding the second cam element $\mathbf{20}_2$ to the first position, the first cam element $\mathbf{20}_1$ is slid to the first position by rotating the camshaft 2 by 90°.

Further, the start position i of the slope 24 formed in the outer circumferential face of the front end face cam 23 of the first cam element $\mathbf{20}_1$ reaches the position of the pin part 32 of the first control device $\mathbf{30}_k$. Here, the power distribution to the first control device $\mathbf{30}_1$ is stopped, and the pin part 32 starts moving to the non-actuated position by the return spring 33. Then, the protruding portion h of the slope 24 of the first cam element $\mathbf{20}_1$ acts to forcibly move the pin part 32 to the non-actuated position while sliding in contact with the pin part 32, according to the rotation of the camshaft 2. The pin part 32 is then kept at the non-actuated position by the return spring 33.

Figure 11C:
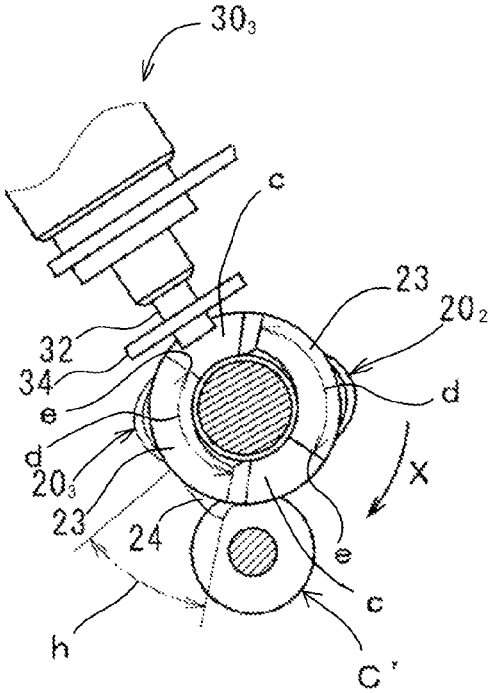
FIG. 11C is a plan view taken along the line x3-x3 in FIG. 1, which illustrates a main part in an operation for switching the cam part for opening and closing the valve from the second cam part to the first cam part.

Next, after the exhaust stroke of the third cylinder $\mathbf{1}_3$ ends, as illustrated in FIG. 11C, since the pin part 32 of the third control device $\mathbf{30}_3$ is in the state of being projected to the position between the opposing face cams 23 of the second and third cam elements $\mathbf{20}_2$ and $\mathbf{20}_3$, the protrusion start position e of the end face cam 23 of the third cam element $\mathbf{20}_3$ reaches the position of the pin part 32 by rotating the camshaft 2 by 90° after the first cam element $\mathbf{20}_1$ being slid to the first position, and the pin part 32 pushes the third cam element $\mathbf{20}_3$ rearward to reach the first position while sliding in contact with the protruding portion d.

Further, the start position i of the slope 24 formed in the outer circumferential face of the rear end face cam 23 of the third cam element $\mathbf{20}_3$ reaches the position of the pin part 32 of the third control device $\mathbf{30}_3$. Here, the power distribution to the third control device $\mathbf{30}_3$ is stopped and the pin part 32 starts moving to the non-actuated position by the return spring 33. Then, the protruding portion h of the slope 24 of the third cam element $\mathbf{20}_3$ acts to forcibly move the pin part 32 to the non-actuated position while sliding in contact with the pin part 32, according to the rotation of the camshaft 2. The pin part 32 is then kept at the non-actuated position by the return spring 33.

Figure 11D:
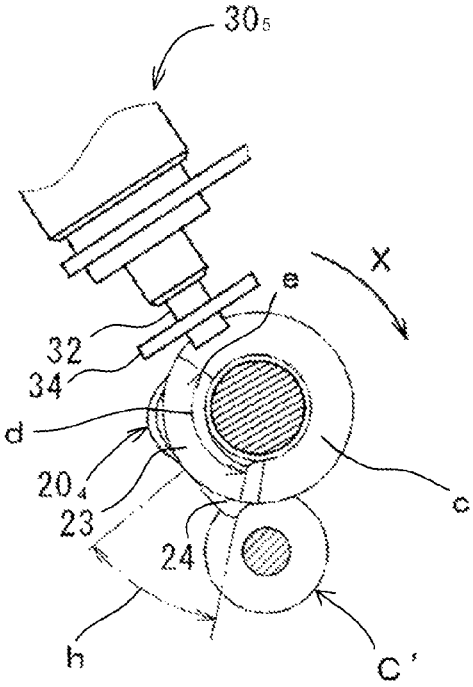
FIG. 11D is a plan view taken along the line x5-x5 in FIG. 1, which illustrates a main part in an operation for switching the cam part for opening and closing the valve from the second cam part to the first cam part.

Next, as illustrated in FIG. 11D, in a period in which the reference surface c of this end face cam 23 is on the same side in the circumferential direction as the oriented position and adjacent in the axial directions to the oriented position, the pin part 32 of the fifth control device $\mathbf{30}_5$ is projected to the position adjacent in the axial directions to the rear end face cam 23 of the fourth cam element $\mathbf{20}_4$ which is at the second position, to engage with the end face cam 23.

Then, after the exhaust stroke of the fourth cylinder $\mathbf{1}_4$ ends, the protrusion start position e of the rear end face cam 23 of the fourth cam element $\mathbf{20}_4$ reaches the position of the pin part 32 of the fifth control device $\mathbf{30}_5$, and then, the pin part 32 pushes the fourth cam element $\mathbf{20}_4$ forward to reach the first position while sliding in contact with the protruding portion d of the end face cam 23 according to the rotation of the camshaft 2.

Further, the start position i of the slope 24 formed in the outer circumferential face of the rear end face cam 23 of the fourth cam element $\mathbf{20}_4$ reaches the position of the pin part 32 of the fifth control device $\mathbf{30}_5$. Here, the power distribution to the fifth control device $\mathbf{30}_5$ is stopped and the pin part 32 starts moving to the non-actuated position by the return spring 33. Then, the protruding portion h of the slope 24 of the fourth cam element $\mathbf{20}_4$ acts to forcibly move the pin part 32 to the non-actuated position while sliding in contact with the pin part 32, according to the rotation of the camshaft 2. The pin part 32 is then kept at the non-actuated position by the return spring 33.

As described above, all the first to fourth cam elements $\mathbf{20}_1$ to $\mathbf{20}_4$ move from the respective second positions to the respective first positions, and as illustrated in FIG. 1, the first cam parts $\mathbf{22}_1$ of the operating parts 22 in both end sections of all the first to fourth cam elements $\mathbf{20}_1$ to $\mathbf{20}_4$ return back to the state where the positions thereof correspond to the cam followers C' of the rocker arms C.

Additionally, the pin parts 32 can be kept at the non-actuated positions by surely and forcibly moving the pin parts 32 of the first, third and fifth control devices $\mathbf{30}_k$, $\mathbf{30}_3$ and $\mathbf{30}_5$ into the main bodies 31 while moving the first to fourth cam elements $\mathbf{20}_1$ to $\mathbf{20}_4$ from the respective second positions to the respective first positions by projecting the pin parts 32 of the first, third, and fifth control devices $\mathbf{30}_k$, $\mathbf{30}_3$, and $\mathbf{30}_5$. In other words, the movements of the first to fourth cam elements $\mathbf{20}_1$ to $\mathbf{20}_4$ and the movements of the pin parts 32 of the first, third, and fifth control devices $\mathbf{30}_k$, $\mathbf{30}_3$, and $\mathbf{30}_5$ to either one of the respective actuated positions and the respective non-actuated positions complete while the camshaft fully rotates once.

As described above, according to this embodiment, the four cam elements $\mathbf{20}_1$ to $\mathbf{20}_4$ provided at the respective four cylinders $\mathbf{1}_1$ to $\mathbf{1}_4$ are controlled by the five control devices $\mathbf{30}_1$ to $\mathbf{30}_5$, and each cam part for opening and closing the exhaust valve A is switched between the first cam part $\mathbf{22}_1$ with the low lift and the second cam part $\mathbf{22}_2$ with the high lift.

Moreover, while the camshaft 2 fully rotates once, the switch operation of the cam part completes and the movements of the pin parts 32 of the respective control devices $\mathbf{30}_1$ to $\mathbf{30}_5$ to the non-actuated positions complete.

Therefore, since interference between the control device and the cam element can surely be prevented even in a case of switching the cam every time the camshaft 2 fully rotates once, in other words, every combustion cycle, the switch operation of the cam part can be performed successively and instantaneously. Moreover, by the simple configuration in which the contact part is provided at each control device and the slope at each cam element, the forcible retreatment of the control device to the non-actuated position can be easily achieved without requiring other kinds of power, and therefore, the size increase of the control device can be avoided. Thus, the switch operation of the cam can be performed successively and instantaneously by surely preventing interference between the control device and the cam element while securing the ease of installation of the control device in the engine.

Moreover, as described above, the protruding portions d of the opposing end face cams 23 overlap with each other in the axial directions when the adjacent cam elements are close to each other, as indicated by "P1" and "P2" in FIG. 1 and "P3" in FIG. 4. Thus, each of the pin parts 32 of the second to fourth control devices $\mathbf{30}_2$ to $\mathbf{30}_4$ each engaging with the end face cams 23 can slide the two cam elements which are close to each other, in the directions of separating them from each other without enlarging the diameter of the pin part 32. Thus, the size reduction of the pin parts 32 can be achieved and the control responsiveness can be increased. Further, the layout of the first and second cam elements $\mathbf{20}_1$ and $\mathbf{20}_2$ and the layout of the third and fourth cam elements $\mathbf{20}_3$ and $\mathbf{20}_4$ may be such that they take up less space when the first and second cam elements $\mathbf{20}_1$ and $\mathbf{20}_2$ are close to each other and the third and fourth cam elements $\mathbf{20}_3$ and $\mathbf{20}_4$ are close to each other, which can stimulate a further reduction in overall size of the camshaft 2 in the axial directions.

Note that, although the above description has been given about the camshaft on the exhaust side, the camshaft on the intake side may be configured similarly or the same, and the same effects can be obtained on the intake side as well.

Moreover, in this embodiment, in all the cam elements $\mathbf{20}_1$ to $\mathbf{20}_4$, the lift in the first cam part $\mathbf{22}_1$ is set low and the lift in the second cam part $\mathbf{22}_2$ is set high; however, this may be the other way around. Further, it may be such that one cam part ($\mathbf{22}_1$' in this modification) is provided with a normal nose part but the other cam part $\mathbf{22}_2$' is formed entirely by just the base circle without a nose part (the lift in the nose part is zero), so that the valve is not opened and closed when the cam part $\mathbf{22}_2$' is used. According to this, a reduced-cylinder operation becomes available in an engine operation at, for example, a low engine load.

Moreover, in this embodiment, the return springs 33 are used to keep the pin parts 32 of the control devices $\mathbf{30}_1$ to $\mathbf{30}_5$ at the non-actuated positions; however, in addition to the return springs 33, magnets, each disposed at either one of the pin part 32 side and the main body 31 side of the control device and attracting the pin part 32 at the non-actuated position, may be provided to configure an operating mechanism with increased retention.

Moreover, the start and end positions of the slope 24 are not limited to this embodiment. The end position f may be different from the end position f of the end face cam 23. Specifically, the slope is only required to have a positional relation in which the movement of the pin part 32 swiftly completes after the movement of the cam element is completed by the cooperation of the end face cam 23 with the pin part 32. For example, the start and end positions of the slope 24 may have a phase in which the end position of the slope 24 is advanced in the rotational direction of the camshaft 2 from the end position f of the end face cam 23.

Moreover, in this embodiment, the example in which the present invention is applied to the four-cylinder, four-valve DOHC engine is described; however, it is also applicable to various kinds of engines with a different number of cylinders and valve operating types, such as single-cylinder engines, inline six-cylinder engines, and V-shaped, multi-cylinder engines.

Note that, the present invention should not be limited to the above embodiment, and various kinds of modifications and changes may be performed without deviating from the spirit or the subject matters of the present invention defined by the following claims.

As described above, according to the present invention, with a valve operating device for an engine of, for example, a vehicle, interference between the control device and the cam element is prevented and the switch operation of the cam part can be performed instantaneously while securing the ease of installation of the control device in the engine, and therefore, the present invention may suitably be adopted in a field of manufacturing industry of such kind of engines.

It should be understood that the embodiments herein are illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

DESCRIPTION OF REFERENCE CHARACTERS

2 Camshaft
10 Shaft
$20_1$ to $20_4$ Cam Element
$22_1$ First Cam Part
$22_2$ Second Cam Part
23 End Face Cam
24 Slope
32 Control Member (Pin Part)
34 Contact Part

What is claimed is:

1. A valve operating device for an engine having a camshaft, the camshaft including a shaft and a cam element fitted onto the shaft to be integrally rotatable with the shaft and movable in axial directions along the shaft, the cam element being provided with two adjacent cam parts having a common base circle for one valve and having nose parts with different shapes, the cam part to open and close the valve being switchable by moving the cam element in the axial directions on the shaft, the valve operating device comprising:

a cam element formed with an end face cam in one end thereof, and a control member, arranged to be movable toward an axial center of the camshaft, driven by an actuator to project to an actuated position at which the control member is projected to engage with the end face cam so as to move the cam element in one of the axial directions, and retreat to a non-actuated position at which the control member is retreated from the actuated position, and wherein the cam element has a slope inclining in a circumferential direction of the cam element and for, when the control member is at the actuated position and the camshaft rotates, sliding in contact with a contact part provided to the control member so as to forcibly move the control member back to the non-actuated position, which separates the control member away from the axial center of the camshaft, after the movement of the cam element via the end face cam is finished.

2. The device of claim 1, wherein the slope is formed in a circumferential face of the end face cam.

3. The device of claim 1, further comprising an actuating part for projecting the control member to the actuated position when the engine is at a predetermined rotational angle and keeping, when the control member is forcibly moved back to the non-actuated position by the slope, the control member at the non-actuated position.

4. The device of claim 2, further comprising an actuating part for projecting the control member to the actuated position when the engine is at a predetermined rotational angle and keeping, when the control member is forcibly moved back to the non-actuated position by the slope, the control member at the non-actuated position.

5. A valve operating device for an engine having a camshaft, the camshaft including a shaft and at least two cam elements fitted onto the shaft to be integrally rotatable with the shaft and movable in axial directions along the shaft, each cam element being provided with two adjacent cam parts having a common base circle for one valve and having nose parts with different shapes, the cam part that opens and closes the valve being switchable by moving the associated cam element in the axial directions on the shaft, the valve operating device comprising:

respective end face cams formed in one end of each of the cam elements, and a control member driven by an actuator to project to an actuated position at which the control member is projected to engage with the end face cam so as to move the cam element in one of the axial directions, and retreat to a non-actuated position at which the control member is retreated from the actuated position, wherein the cam element has a slope inclining in a circumferential direction of the cam element and for, when the control member is at the actuated position, sliding in contact with a contact part provided to the control member so as to forcibly move the control member back to the non-actuated position after the movement of the cam element via the end face cam is finished;

wherein the end face cams are formed in opposing end faces of two adjacent cam elements, and the end face cams respectively have protruding portions being formed offset in phase so that the protruding portions overlap in the axial directions when the two cam elements are close to each other, wherein the control member is projected to an actuated position at which the control member is projected to engage with the end face cams so as to separate the adjacent cam elements from each other when the cam elements are close to each other, and the control member is retreated to a non-actuated position at which the control member is retreated from the actuated position, and wherein the slope is formed in one of the adjacent cam elements separated later than the other cam element by the projected control member.

6. The device of claim 5, wherein the slope is formed in a circumferential face of the end face cam.

7. The device of claim 6, further comprising an actuating part for projecting the control member to the actuated position when the engine is at a predetermined rotational angle and keeping, when the control member is forcibly moved back to the non-actuated position by the slope, the control member at the non-actuated position.

8. The device of claim 5, further comprising an actuating part for projecting the control member to the actuated position when the engine is at a predetermined rotational angle and keeping, when the control member is forcibly moved back to the non-actuated position by the slope, the control member at the non-actuated position.

9. A valve operating device for an engine having a camshaft, the camshaft including a shaft and at least two cam elements fitted onto the shaft to be integrally rotatable with the shaft and movable in axial directions along the shaft, each cam element being provided with two adjacent cam parts having a common base circle for one valve and having nose parts with different shapes, the cam part that opens and closes the valve being switchable by moving the associated cam element in the axial directions on the shaft, the valve operating device comprising:

respective end face cams formed in one end of each cam element, and a control member driven by an actuator to project to an actuated position at which the control member is projected to engage with the end face cam so as to move the cam element in one of the axial directions, and retreat to a non-actuated position at which the control member is retreated from the actuated position, wherein the cam element has a slope inclining in a circumferential direction of the cam element and for, when the control member is at the actuated position, sliding in contact with a contact part provided to the control member so as to forcibly move the control member back to the non-actuated position, after the movement of the cam element via the end face cam is finished;

wherein the end face cams are formed in opposing end faces of two adjacent cam elements, and the end face cams respectively have protruding portions being formed offset in phase so that the protruding portions overlap in the axial directions when the two cam elements are close to each other, wherein the control member is projected to the actuated position at which the control member is projected to engage with the end face cams so as to separate the adjacent cam elements from each other when the cam elements are close to each other, and the control member is retreated to non-actuated position at which the control member is retreated from the actuated position, wherein second end face cams are formed in the other end faces of the two adjacent cam elements, and wherein second control members are provided for the respective two cam elements, each of the second control members is projected to an actuated position at which the second control member is projected, in a state where the cam element is separated from the adjacent cam element, to engage with the second end face cams so as to move the cam element to be close to the adjacent cam element, and each of the second control members is retreated to a non-actuated position at which the second control member is retreated from the actuated position.

10. The device of claim 9, wherein the slope is formed in a circumferential face of the end face cam.

11. The device of claim 10, further comprising an actuating part for projecting the control member to the actuated position when the engine is at a predetermined rotational angle and keeping, when the control member is forcibly moved back to the non-actuated position by the slope, the control member at the non-actuated position.

12. The device of claim 9, further comprising an actuating part for projecting the control member to the actuated position when the engine is at a predetermined rotational angle and keeping, when the control member is forcibly moved back to the non-actuated position by the slope, the control member at the non-actuated position.

* * * * *